US010997964B2

(12) United States Patent
Golipour et al.

(10) Patent No.: US 10,997,964 B2
(45) Date of Patent: *May 4, 2021

(54) SYSTEM AND METHOD FOR TEXT NORMALIZATION USING ATOMIC TOKENS

(71) Applicant: AT&T Intellectual Property I, L.P., Atlanta, GA (US)

(72) Inventors: Ladan Golipour, Morristown, NJ (US); Alistair D. Conkie, Morristown, NJ (US)

(73) Assignee: AT&T INTELLECTUAL PROPERTY 1, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/542,514

(22) Filed: Aug. 16, 2019

(65) Prior Publication Data

US 2019/0371294 A1 Dec. 5, 2019

Related U.S. Application Data

(63) Continuation of application No. 14/533,589, filed on Nov. 5, 2014, now Pat. No. 10,388,270.

(51) Int. Cl.
*G10L 13/00* (2006.01)
*G10L 13/10* (2013.01)

(52) U.S. Cl.
CPC ..... *G10L 13/10* (2013.01)

(58) Field of Classification Search
USPC ..... 704/260
See application file for complete search history.

(56) References Cited

U.S. PATENT DOCUMENTS 6,321,372 B1 11/2001 Poirier
6,442,523 B1 8/2002 Siegel
6,606,598 B1 * 8/2003 Holthouse ..... G10L 15/01 704/236
6,810,375 B1 10/2004 Ejerhed
6,963,832 B2 11/2005 Vanhilst
(Continued)

OTHER PUBLICATIONS

Xydas et al., "Text Normalization for the Pronunciation of Non-standard Words in an Inflected Language," Methods and Applications of Artificial Intelligence. Springer Berlin Heidelberg, 2004. 390-399.

(Continued)

*Primary Examiner* — Jakieda R Jackson

(57) ABSTRACT

A system, method and computer-readable storage devices are for normalizing text for ASR and TTS in a language-neutral way. The system described herein divides Unicode text into meaningful chunks called "atomic tokens." The atomic tokens strongly correlate to their actual pronunciation, and not to their meaning. The system combines the tokenization with a data-driven classification scheme, followed by class-determined actions to convert text to normalized form. The classification labels are based on pronunciation, unlike alternative approaches that typically employ Named Entity-based categories. Thus, this approach is relatively simple to adapt to new languages. Non-experts can easily annotate training data because the tokens are based on pronunciation alone.

18 Claims, 5 Drawing Sheets

(56) References Cited

U.S. PATENT DOCUMENTS 7,092,871 B2 * 8/2006 Pentheroudakis .. G06F 17/2725 704/9
7,302,394 B1 * 11/2007 Baray ..... G10L 15/18 704/257
7,672,832 B2 3/2010 Huang et al.
8,024,174 B2 9/2011 Wang et al.
8,027,837 B2 9/2011 Silverman et al.
8,352,270 B2 1/2013 Wang et al.
8,612,205 B2 12/2013 Hanneman et al.
8,626,486 B2 1/2014 Och et al.
8,688,455 B2 4/2014 Bells et al.
8,701,162 B1 4/2014 Pedersen
8,849,651 B2 9/2014 Selegey et al.
8,924,212 B1 12/2014 Allauzen
2001/0056344 A1 * 12/2001 Ramaswamy ..... G10L 15/22 704/235
2003/0069880 A1 4/2003 Harrison
2003/0088415 A1 5/2003 Kobal
2003/0149562 A1 * 8/2003 Walther ..... G06F 17/277 704/243
2004/0073427 A1 4/2004 Moore
2004/0078204 A1 4/2004 Segond
2005/0267757 A1 12/2005 Iso-Sipila
2006/0116862 A1 6/2006 Carrier
2006/0149558 A1 7/2006 Kahn
2006/0277030 A1 12/2006 Bedworth
2007/0016398 A1 * 1/2007 Buchholz ..... G06F 17/2705 704/4
2007/0294179 A1 12/2007 Krawetz
2008/0147656 A1 6/2008 Kahn
2009/0037174 A1 2/2009 Seltzer
2009/0157830 A1 * 6/2009 Kim ..... G06F 16/434 709/206
2009/0240501 A1 9/2009 Chen
2009/0326925 A1 12/2009 Crider
2010/0010815 A1 * 1/2010 Bells ..... G10L 13/027 704/260
2010/0306260 A1 12/2010 Dejean
2010/0332224 A1 12/2010 Makela et al.
2011/0040552 A1 2/2011 Van Guilder
2012/0089400 A1 4/2012 Henton
2012/0179694 A1 * 7/2012 Sciacca ..... G06F 16/3338 707/748
2012/0290511 A1 * 11/2012 Frank ..... G06N 20/00 706/12
2012/0303355 A1 * 11/2012 Liu ..... G06F 40/274 704/9
2012/0330971 A1 * 12/2012 Thomas ..... G06F 16/3334 707/748
2013/0006973 A1 1/2013 Caldwell
2013/0007648 A1 1/2013 Gamon
2013/0103624 A1 * 4/2013 Thieberger ..... G06N 5/046 706/12
2013/0173258 A1 * 7/2013 Liu ..... G06F 40/40 704/9
2013/0246098 A1 * 9/2013 Habboush ..... G06N 3/0454 705/3
2013/0339000 A1 12/2013 Zhang et al.
2014/0201113 A1 * 7/2014 Harz ..... H04L 67/02 706/12
2014/0222415 A1 8/2014 Legat
2016/0110528 A1 4/2016 Gupta

OTHER PUBLICATIONS

Mollá, Diego, Menno van Zaanen, and Steve Cassidy. "Named entity recognition in question answering of speech data." Proceedings of the Australasian Language Technology Workshop. 2007.
Liberman, Mark Y., and Kenneth W. Church. "Text analysis and word pronunciation in text-to-speech synthesis." Advances in speech signal processing (1992): 791-831.
Sproat et al., "Normalization of Non-Standard Words," *Computer Speech and Language*, 2001, 15, pp. 287-333.
Olinsky et al., "Non-Standard Word and Homograph Resolution for Asian Language Text Analysis," *ICSLP* 2000, Beijing, 4 pages.
Jia et al., "Text Normalization in Mandarin Text-to-Speech System," *ICASSP* 2008, Las Vegas, pp. 4693-4696.
Zhou et al., "A Three-Stage Text Normalization Strategy for Mandarin Text-to-Speech Systems," *ISCSLEP* 2008, pp. 1-4.
Schlippe et al., "Text Normalization based on Statistical Machine Translation and Internet User Support," *INTERSPEECH* 2010, 4 pages.
Koehn et al., "Moses: Open Source Toolkit for Statistical Machine Translation," *Proceedings of the 45th Annual Meeting of the ACL on Interactive Poster and Demonstration Sessions*, Prague, Czech Republic, 2007, p. 177-180.
Eds: Mark Davis, Laurentiu Iancu, and Ken Whistler, "Unicode Character Database," http://www.unicode.org/reports/tr44/2013.
Graff et al., "English Gigaword Third Edition," Linguistic Data Consortium, Philadelphia 2007.
Reichel et al., Text Preprocessing for speech synthesis, 2006, University of Munich, full document.

* cited by examiner

SYSTEM AND METHOD FOR TEXT NORMALIZATION USING ATOMIC TOKENS

PRIORITY INFORMATION

The present application is a continuation of U.S. patent application Ser. No. 14/533,589, filed Nov. 5, 2014, the content of which is incorporated herein by reference in its entirety.

BACKGROUND

1. Technical Field

The present disclosure relates to normalizing text and more specifically to language independent text normalization using atomic tokens and classification labels.

2. Introduction

Text normalization is a way of adapting text to a standard form, such as for comparison to other normalized text or for facilitating searches. One approach to data-driven text normalization is to annotate text data manually in concordance format, according to a set of category labels. This approach breaks data processing into two parts, (a) a version of Named Entity extraction, and (b) subsequent actions based on the entities. This approach seeks, approximately, to reproduce the steps that might be carried out in a traditional hand-crafted text-to-speech (TTS) system. The patterns to be classified are generally language-specific, and are typically separated by white space. This approach does not translate well to other languages. For example, when moving English to Asian languages, two major differences are calculating word boundaries, and that not all the English labels are relevant for Asian languages. The complexity of the rules required for dealing with the broad categories of text are difficult to overcome.

In Asian languages, letter expansions are generally much simpler than for English while number expansions are similar in complexity. One approach exemplified by Chinese text focuses solely on normalization rather than word splitting. This approach uses a Finite State Automaton (FSA) to give an initial classification followed by a Maximum Entropy (MaxEnt) classifier to distinguish subclasses. The Moses Machine Translation (MT) framework considers normalization to be a form of machine translation. The primary goal of the Moses MT framework is to evaluate how effective Statistical Machine Translation (SMT) is in the context of normalizing text in a language, both in terms of having unskilled "translators" and the pros and cons of combinations of SMT and language-independent and language-specific rules. None of these approaches is language neutral and none normalizes text for both TTS and automatic speech recognition (ASR) purposes.

DETAILED DESCRIPTION

A system, method and computer-readable storage devices are disclosed which train data for normalizing text in a language neutral way and so that the normalized text can be used for both TTS and ASR. A system operating per this disclosure defines simple "atomic" tokens that are processed by a MaxEnt-based classifier trained on labeled text data. The labels correspond to pronunciations rather than any predefined Named Entity categories. The annotation of the training data is a relatively simple task for non-experts. For each class, the system uses a distinct text conversion process to provide normalized text that can be spoken by a synthesizer or used for ASR text normalization purposes.

The system operation is based on two observations. First, Unicode provides a general framework that can be used to divide text into meaningful chunks ("atomic" tokens). Second, a strong correlation exists between the "atomic" tokens and pronunciations. The tokenization approach described herein combines with a data-driven classification scheme, followed by class-determined actions to convert text to normalized form. The classification labels are based on pronunciation, unlike alternative approaches that typically employ Named Entity-based categories. Labels based on pronunciation can more readily be adapted to new languages. Annotation of training data by non-experts is also straightforward. Occasionally conversion from tokens to a normalized form will require reordering, also accommodated by this disclosure. The systems disclosed herein apply tokenization and labeling training, each of which will be discussed below.

Such a system for text normalization can be constructed in various embodiments and configurations. Some of the various embodiments of the disclosure are described in detail below. While specific implementations are described, it should be understood that this is done for illustration purposes only. Other components and configurations may be used without parting from the spirit and scope of the disclosure. A brief introductory description of a basic general purpose system or computing device in FIG. 1 which can be employed to practice the concepts, methods, and techniques disclosed is illustrated. A more detailed description of the text normalization systems using tokenization and labels will then follow.

Figure 1:
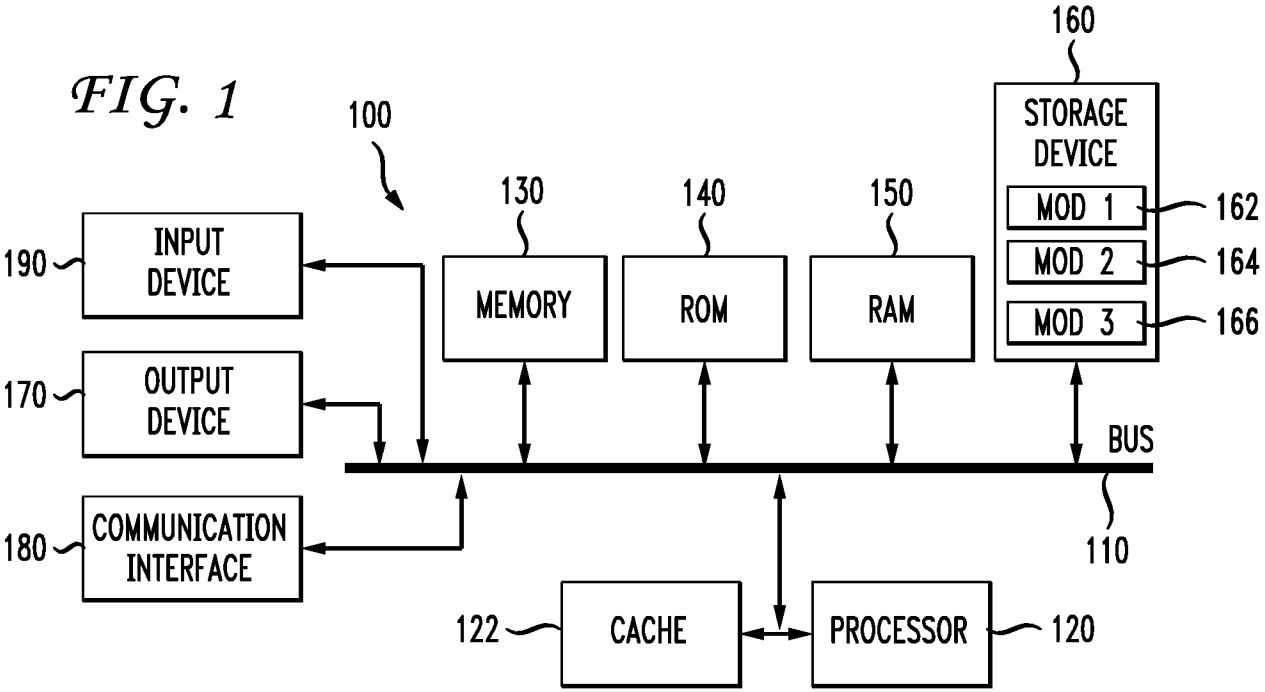
FIG. 1 illustrates an example system embodiment.

With reference to FIG. 1, an exemplary system and/or computing device 100 includes a processing unit (CPU or processor) 120 and a system bus 110 that couples various system components including the system memory 130 such as read only memory (ROM) 140 and random access memory (RAM) 150 to the processor 120. The system 100 can include a cache 122 of high-speed memory connected directly with, in close proximity to, or integrated as part of the processor 120. The system 100 copies data from the memory 130 and/or the storage device 160 to the cache 122 for quick access by the processor 120. In this way, the cache provides a performance boost that avoids processor 120 delays while waiting for data. These and other modules can control or be configured to control the processor 120 to perform various operations or actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the processor. The processor 120 may be a self-contained computing system, containing multiple cores or processors, a bus, memory controller, cache, etc. A multi-core processor may be symmetric or asymmetric. The processor 120 can include multiple processors, such as a system having multiple, physically separate processors in different sockets, or a system having multiple processor cores on a single physical chip. Similarly, the processor 120 can include multiple distributed processors located in multiple separate computing devices, but working together such as via a communications network. Multiple processors or processor cores can share resources such as memory 130 or the cache 122, or can operate using independent resources. The processor 120 can include one or more of a state machine, an application specific integrated circuit (ASIC), or a programmable gate array (PGA) including a field PGA.

The system bus 110 may be any of several types of bus structures including a memory bus or memory controller, a peripheral bus, and a local bus using any of a variety of bus architectures. A basic input/output (BIOS) stored in ROM 140 or the like, may provide the basic routine that helps to transfer information between elements within the computing device 100, such as during start-up. The computing device 100 further includes storage devices 160 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. The storage device 160 can include software modules 162, 164, 166 for controlling the processor 120. The system 100 can include other hardware or software modules. The storage device 160 is connected to the system bus 110 by a drive interface. The drives and the associated computer-readable storage devices provide nonvolatile storage of computer-readable instructions, data structures, program modules and other data for the computing device 100. In one aspect, a hardware module that performs a particular function includes the software component stored in a tangible computer-readable storage device in connection with the necessary hardware components, such as the processor 120, bus 110, display 170, and so forth, to carry out a particular function. In another aspect, the system can use a processor and computer-readable storage device to store instructions which, when executed by the processor, cause the processor to perform operations, a method or other specific actions. The basic components and appropriate variations can be modified depending on the type of device, such as whether the device 100 is a small, handheld computing device, a desktop computer, or a computer server. When the processor 120 executes instructions to perform "operations", the processor 120 can perform the operations directly and/or facilitate, direct, or cooperate with another device or component to perform the operations.

Although the exemplary embodiment(s) described herein employs the hard disk 160, other types of computer-readable storage devices which can store data that are accessible by a computer, such as magnetic cassettes, flash memory cards, digital versatile disks (DVDs), cartridges, random access memories (RAMs) 150, read only memory (ROM) 140, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic hardware depicted may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations described below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited tangible computer-readable storage devices. Such logical operations can be implemented as modules configured to control the processor 120 to perform particular functions according to the programming of the module. For example, FIG. 1 illustrates three modules Mod1 162, Mod2 164 and Mod3 166 which are modules configured to control the processor 120. These modules may be stored on the storage device 160 and loaded into RAM 150 or memory 130 at runtime or may be stored in other computer-readable memory locations.

One or more parts of the example computing device 100, up to and including the entire computing device 100, can be virtualized. For example, a virtual processor can be a software object that executes according to a particular instruction set, even when a physical processor of the same type as the virtual processor is unavailable. A virtualization layer or a virtual "host" can enable virtualized components of one or more different computing devices or device types by translating virtualized operations to actual operations. Ultimately however, virtualized hardware of every type is implemented or executed by some underlying physical hardware. Thus, a virtualization compute layer can operate on top of a physical compute layer. The virtualization compute layer can include one or more of a virtual machine, an overlay network, a hypervisor, virtual switching, and any other virtualization application.

The processor 120 can include all types of processors disclosed herein, including a virtual processor. However, when referring to a virtual processor, the processor 120 includes the software components associated with executing the virtual processor in a virtualization layer and underlying hardware necessary to execute the virtualization layer. The system 100 can include a physical or virtual processor 120 that receive instructions stored in a computer-readable storage device, which cause the processor 120 to perform certain operations. When referring to a virtual processor 120, the system also includes the underlying physical hardware executing the virtual processor 120.

Having disclosed some components of a computer system which can be used to implement all or part of the principles set forth herein, the disclosure returns to a discussion of normalizing text. The system tokenizes input text, such as a corpus of Unicode text, into "atomic" components, then performs feature extraction on the tokenized text to generate training data for normalizing text.

Figure 2:
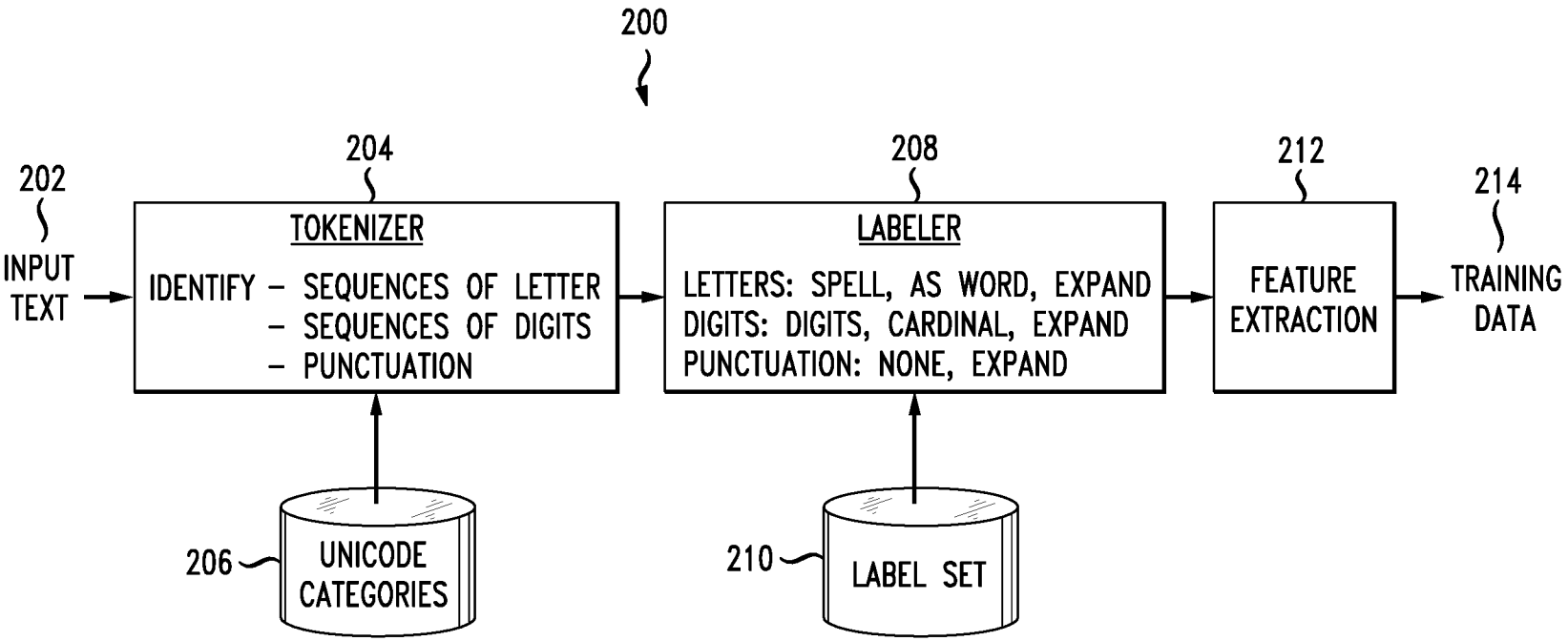
FIG. 2 illustrates an example system architecture for text normalization using atomic tokens.

FIG. 2 illustrates an example system architecture 200 for text normalization using atomic tokens. The system 200 includes a tokenizer 204 that receives input text 202. The input text 202 is typically Unicode text, and can include whitespace. The tokenizer 204 divides the input text 202 into "atomic" tokens by recognizing three types of token: (1) a sequence of letters (or ideograms), (2) a sequence of digits, and (3) individual punctuation characters. One benefit of this approach is that the labels remain very simple, so the Unicode categories 206 are easier and faster to process. The Unicode standard defines "category" as an integral part of the Unicode standard, which the system can leverage in a general multilingual approach. For example, the labeler 208 uses Unicode-defined broad categories L ("letter") and N ("number"), and labels everything else not considered L, N, or white space as P ("punctuation") as defined in the Unicode standard.

The tokenizer 204 processes the input text 202 in a more general way than space-based tokenization. For example, languages with ideograms typically don't use spaces between words. The labeler 208 selects labels from label sets 210 to assign to the tokenized text, such as the example label sets 210 provided below in Table 1. The example label sets 210 are not limiting. The label sets 210 can include a larger or smaller number of labels than the ones shown in Table 1. Each label in the label sets 210 has a corresponding action or behavior for that type of labeled token.

TABLE 1

| | For letter sequences, 4 possible labels |
|---|---|
| SPELL | Pronounce sequence as individual letters |
| ASWORD | Pronounce as a regular word |
| EXPAND | Idiosyncratic (use sub-label) |
| SPELLs | To distinguish, e.g. IDs or IDS |
| | For number sequences, 3 possible labels |
| DIGITS | Pronounce as individual digits |
| CARDINAL | Pronounce as integers, decimals |
| EXPAND | Idiosyncratic, e.g. I-287 (use sub-label) |
| | For punctuation, 2 possible labels |
| NONE | Not spoken (most things) |
| EXPAND | Needs expansion (use sub-label) |
| | Anomalous tokens, 4 possible labels |

TABLE 1-continued

| | For letter sequences, 4 possible labels |
|---|---|
| FOREIGN | For obviously foreign words (not names) |
| MISC | Anything that does not seem meaningful |
| SPLIT | Where a pronunciation needs multiple tokens |
| REORDER | Where reordering is necessary, e.g. $5 |

The labels in the label sets 210 are based on categories, but refer only to pronunciations and not to any specific Named Entities. In this example, only EXPAND, SPLIT and REORDER have sub-labels. Two labels deserve some additional comments. SPLIT is used in cases such as "3$^{rd}$," which is tokenized as "3" and "rd", where more than one token is required to be present to pronounce a word properly. In this case, the label would be "SPLIT:third." Sometimes pronunciations are reordered, e.g. "$12 billion" is pronounced "twelve billion dollars." In this case, automatic or human labelers use REORDER to indicate what happens. In English one common example of REORDER is in relation to currency examples, while in Chinese REORDER also applies to percentages.

The labeling guidelines were refined over time to facilitate the manual labeling task. For example REORDER originally applied to all the members of a group to be reordered, but after consideration of test data, was modified to apply to just the currency element, at least for English, which was more reliable.

For actions, certain basic actions such as SPELL and ASWORD are essentially language-independent. Others may be more limited in scope. A set of possible actions can be shared across languages. If new actions are needed, the system can expand the list of available actions in a language-independent way. Some actions, such as EXPAND, will inevitably be mostly language-specific.

The labeler 208 outputs labeled atomic tokens from the input text 202 to a feature extraction module 212. The feature extraction module 212 performs two steps. First, the feature extraction module 212 extracts a number of morphological and lexical text features from every token and its n-left/n-right tokens. In one embodiment, the number of morphological and lexical text features is 28. These feature extraction module 212 can compute and extract features either from the token or the word from which the token originates. Some examples are: is_number_only, is_alpha_only, has_money_sign, token_string, token_shape, token_length, is_token_in_dictionary, etc. The feature extraction module 212 can construct a feature vector by concatenating the features of the n-left context tokens, the token itself, and n-right context tokens. The feature set can include both categorical and binary features. Binary features can be represented as categorical and can also use n-grams of features. In one embodiment, binary features are only included if the feature is present. The feature extraction module 212 generates training data 214 which can be used to train an automatic labeler, tokenizer, or other component of a text processing system.

Figure 3:
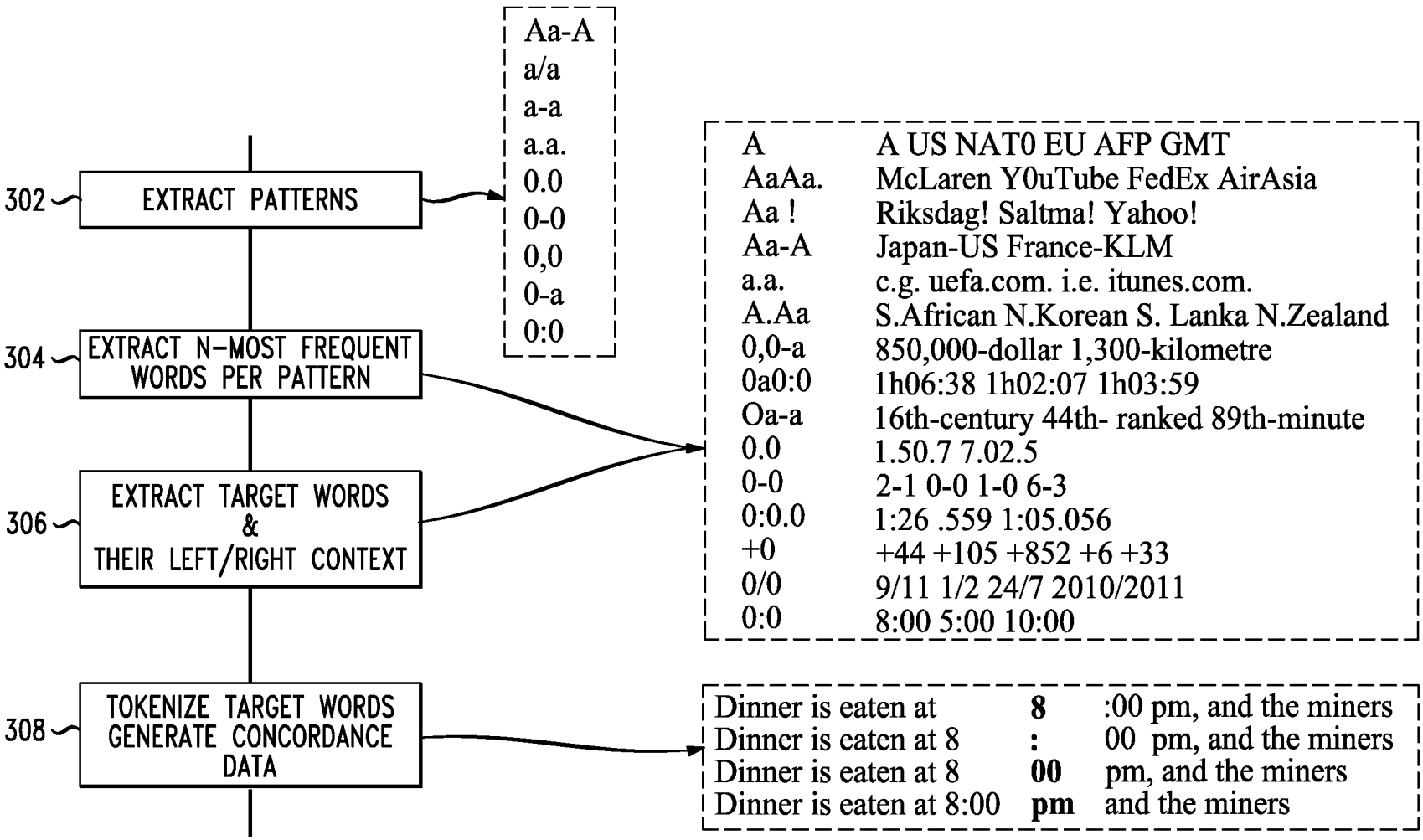
FIG. 3 illustrates an example training procedure.
Figure 3:
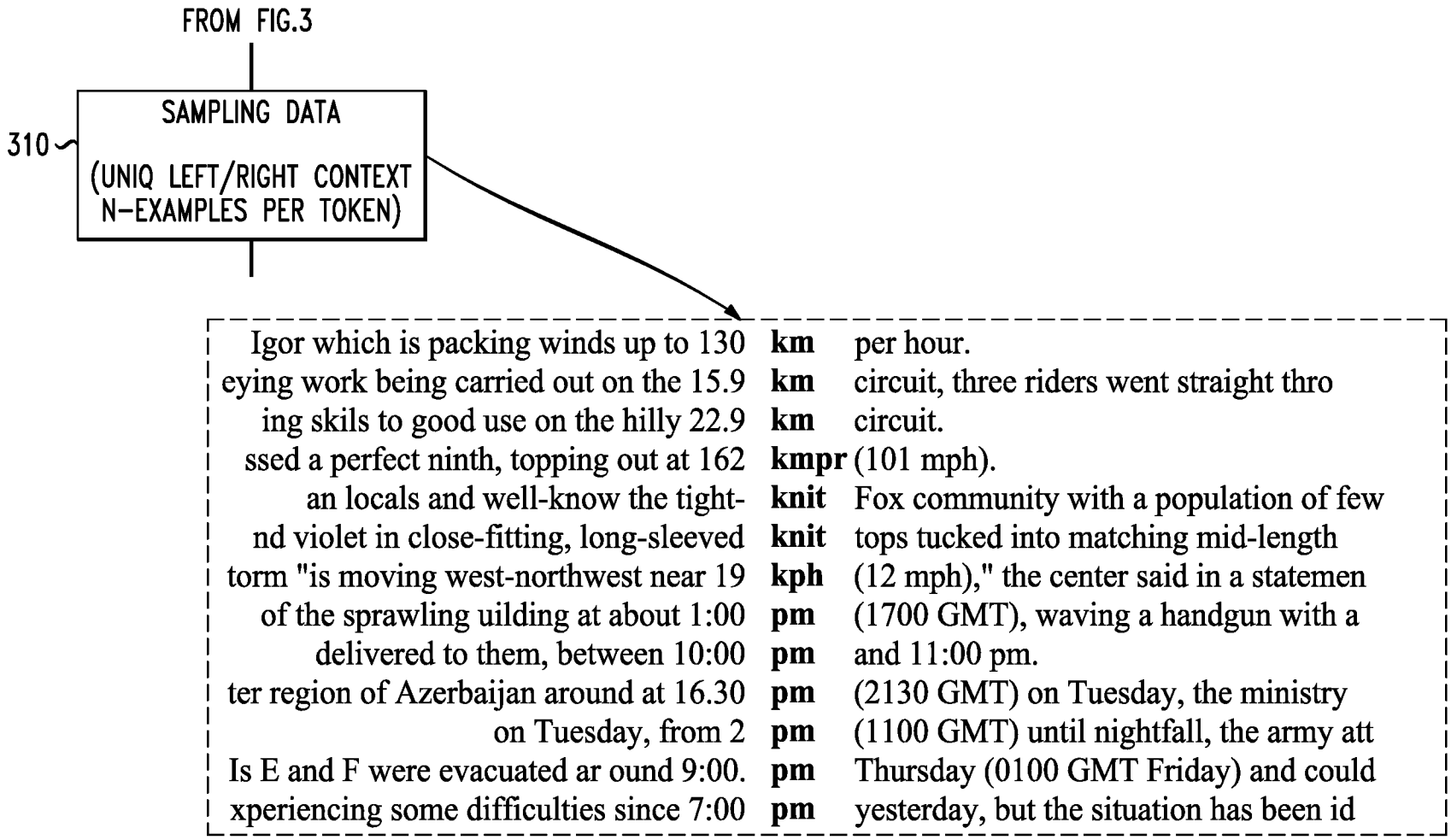

An experimental system for text normalization using atomic tokens used the Gigaword corpus as the base corpus to generate the training data. Since the majority of words in a corpus likely fall in the category ASWORD, labeling the whole corpus blindly was an inefficient use of labeling resources. An algorithm extracts patterns that most likely require some non-ASWORD form of normalization. FIG. 3 illustrates a block diagram of this algorithm for use in the example training procedure.

In order to generate the patterns, the system passes the word list through a filter which performs as below:

[a-z]+→a

[A-Z]+→A

[0-9]+→0

This process extracts or converts the word list into a pattern list 302. Next, the system generates a list of N most frequent words 304, called "target" words per pattern. Then, the system extracts all instances of target words 306 alongside their left/right context words from the base corpus. For every target token, the system constructs each line as concordance data 308 by composing three tab-separated columns as shown in FIG. 3. Finally, depending on availability of labeling resources, the system samples training data 310 using heuristic rules such as selecting lines with unique left and/or right context words, or setting a threshold on the maximum number of examples per target token. Table 2 below shows the training data after processing the base corpus and labeling the target tokens, and shows example classes assigned to a particular token, as well as the left and/or right contexts.

TABLE 2

| Class | Left context | Token | Right context |
|---|---|---|---|
| SPELL | emporté des documents confidentiels de | GM | lorsqu'ils ont démissionné en bloc du g |
| ASWORD | cité de stockage sur disque optique, CD- | ROM | , CD-R, CD-Audio. Sur un meme CD on |
| EXPAND:heure | t Zagreb, 9H30 (7H30 GMT) et 14H00 (12 | H | 00 GMT), a précisé l'officier. Puis les pé |
| DIGITS | ABC | 123 | |
| CARDINAL | e) et 270.000 exploitations agricoles ( | 10 | % de l'ensemble mais plus d'un tiers de l |
| SPLIT:troisieme | ojection en compétition officielle, du | 3 | ème volet de lat trilogie du Polanais Krzys |
| EXPAND:seven_forty_seven | jumbo jet | 747 | |
| NONE | M organ (Aus/N.7) bat Juan Garat (arg) 6 | — | 1, 6-2 Mark Woodforde (Aus) bat Jimmy |
| EXPAND:pour_cent | anciennes, qui ne couvrent plus que 12 | % | de la planète contre 32% au début de la |
| FOREIGN | Derrière les "big | Players | ", Footwork (Gianni Morbidelli - Chris 1234567890 FIN) |
| MISC | RYRYRYRYRYRYRYR | Y | 123456789 FIN |

An example classifier can offer the choice between standard sparse vector input (SVM lite format) and unstructured input that requires further feature extraction (for instance text, with n-gram feature extraction). Unstructured input can be used when textual features are available. The example classifier can implement Large Margin algorithms such as SVMs, AdaBoost, or Regularized Maximum Entropy.

An experimental classifier operated using two classification algorithms: linear SVM and MaxEnt. The experimental classifier processed various n-grams (n=1 to n=4) and two context window sizes, ±2 and ±4, to investigate the effect of context information on the classification error rate. The experimental classifier also used different cut-off thresholds for the n-gram frequency.

Table 3, reproduced below, summarizes the experimental results for various setups. The experimental classifier achieved the lowest error rate with a 3-gram MaxEnt model with ±2 context and a cut-off frequency of 1. These configurations are based on a context of ±4 that shows evidence of the model overfitting the training data.

TABLE 3

| Setup | exp1 | exp2 | exp3 | exp4 | exp5 | exp6 | exp7 |
|---|---|---|---|---|---|---|---|
| Linear SVM | + | | | | | | |
| Maxent | | + | + | + | + | + | + |
| 2-right/2-left | + | + | | + | + | | + |
| 4-right/4-left | | | + | | | | |
| 4-gram | | | | + | | | + |
| 3-gram | + | + | + | | | | |
| 2-gram | | | | | + | | |
| 1-gram | | | | | | + | |
| cut-off 3 | + | + | + | + | + | + | + |
| cut-off 1 | | | | | | | |
| test err (%) | 0.200 | 0.165 | 0.167 | 0.165 | 0.171 | 0.207 | 0.155 |

The experimental data showed that the largest confusion occurs between the class EXPAND and SPELL. This is mostly on abbreviations such as "pm" for which the proper normalization action can only be determined based on the context in which the token is present. For example, in some cases the "PM" token expands to "prime minister" such as in a context where the French PM speaks to the nation. In other cases, the "PM" token is pronounced "pee-em" such as in the context of "I'll meet you at 3:45 pm." The EXPAND class covers non-overlapping categories and could be split into three distinct categories. For some feature sets this results in an improvement, but in other configurations the reverse was found to be true.

Figure 4:
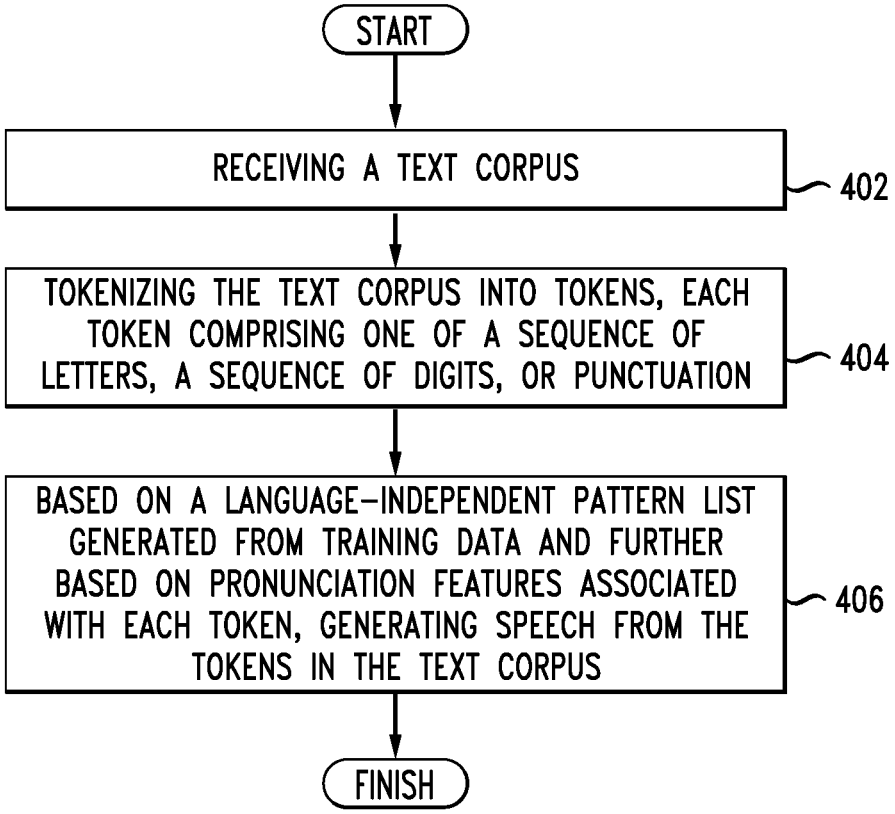
FIG. 4 illustrates an example method embodiment.

FIG. 4 illustrates an example method embodiment for normalizing text. Text normalization applies to text-to-speech, automatic speech recognition, natural language understanding, and dialog management because all of these applications rely on, use, or generate text data. ASR in particular can benefit from gathering as much text data as possible for a given speech model or language model. Source data like web pages often have a lot of noise in the data, like numbers, different formatting, etc. Numbers can be represented as digits, typed out words, or in other representations. Normalization unifies the text representations so the system can more easily understand what the user wants or what the user intended to state. The steps shown can be performed in any order, can include all or part of the steps shown, and can include other steps or modifications in any combination or permutation consistent with the disclosure.

An example system configured to perform the method receives a text corpus (402). The text corpus can be from a single source or of a single type, or can be from multiple sources and be of multiple types. For example, the text corpus can originate from a website, from a book, a chat history, emails, and so forth. The text corpus can be authored by multiple individuals. Then the system can tokenize the text corpus into tokens, each token including one of a sequence of letters, a sequence of digits, or punctuation (404). The tokens are not large size tokens such as a word or a space separated token, but are instead "atomic tokens." This approach is useful because a larger token such as the word 'token' itself would require extra meta information (indicating, for example, whether the token is a date, a number, a time, a name, and so forth) in order to then normalize the text. The meta information would require expert labeling which is expensive and time consuming. Instead, these atomic tokens, such as the tokens indicated in the token column of Table 2, are more or less the same and non-experts can easily label the data. Atomic tokens can include any concatenation of characters, whether alphanumeric, punctuation, or others. Classes can define and label the tokens. The token and label framework is based on how the token is pronounced, rather than what it is. Because the tokens are labeled based on pronunciation, this approach is language independent. The tokenizer can work on Unicode text, which includes most languages.

The system can further examine the context of the tokens, such as the left and right context in the text, to decide how to classify the tokens. The context of the token can provide all the features so the system can label the token correctly. Sometimes different tokens are pronounced differently in different contexts (PM as in time versus PM as in prime minister). The system can decide from context which pronunciation or which classification to select.

Based on a language-independent pattern list generated from training data and further based on pronunciation guidelines or features associated with each token, the system generates speech from the tokens in the text corpus (406). Alternatively, the system can generate pronunciation guidelines or categorize the token into a class that instructs a text-to-speech module how to treat the token. The pronunciation guidelines can include at least one of spell, expand, reorder, asword, digits, cardinal, split, none, and foreign. The system can further generate speech for a given token based on N tokens to a left context or a right context of the given token.

After getting the data, training the model, the system can use that normalized text in conjunction with or during ASR or TTS. The system receives the text to be rendered by the TTS, normalizes the text, and passes the normalized atomic tokens to the TTS system. The text and tokens provided are more robust, and lead to higher accuracy speech synthesis. In this way, the system normalizes text in a data driven way, so that the normalizer and resulting output improve as more data is provided. This is a distinct improvement over text normalization using rules and regular expressions alone.

The method and other principles set forth herein provide a language-neutral way to normalize text for TTS and ASR. This tokenization method is combined with a data-driven classification scheme, followed by class-determined actions. The classification labels are based on pronunciation, unlike alternative approaches that typically employ Named Entity based categories. The classification labels are easily adaptable to new languages. Further, non-experts can manually annotate training data. Active learning can enrich the training data with examples intended to reduce inter-class confusion.

Embodiments within the scope of the present disclosure may also include tangible and/or non-transitory computer-readable storage devices for carrying or having computer-executable instructions or data structures stored thereon. Such tangible computer-readable storage devices can be any available device that can be accessed by a general purpose or special purpose computer, including the functional design of any special purpose processor as described above. By way of example, and not limitation, such tangible computer-readable devices can include RAM, ROM, EEPROM, CD-ROM or other optical disk storage, magnetic disk storage or other magnetic storage devices, or any other device which can be used to carry or store desired program code in the form of computer-executable instructions, data structures, or processor chip design. When information or instructions are provided via a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. For example, the principles herein apply to a unified framework of ASR and TTS using a common normalization and dictionary, but can also apply to performing ASR and TTS using a common dictionary without normalization. Various modifications and changes may be made to the principles described herein without following the example embodiments and applications illustrated and described herein, and without departing from the spirit and scope of the disclosure. Claim language reciting "at least one of" a set indicates that one member of the set or multiple members of the set satisfy the claim.

We claim:

1. A method comprising:

receiving a text corpus;

tokenizing, via a tokenization module on a computing device, the text corpus into application tokens, each application token of the application tokens comprising one of: a sequence of letters, a sequence of digits, and a punctuation, wherein the tokenization module is trained on training data generated by a feature extraction module that extracts morphological and lexical text features from each of a training data token and from an n-left token associated with the training data token or an n-right token associated with the training data token, wherein the tokenizing further comprises: for the each application token of the application tokens, assigning a label to the each application token based on a pronunciation of the sequence of letters, the sequence of digits, or the punctuation corresponding to the each application token, wherein the text-to-speech pronunciation guideline is identified based on the label, and wherein there are multiple candidate pronunciations for the sequence of letters, the sequence of digits, or the punctuation, and the pronunciation is selected from among the multiple candidate pronunciations based on a context of the each application token;

identifying a text-to-speech pronunciation guideline associated with each application token in the application tokens, wherein the text-to-speech pronunciation guideline comprises at least one of: a reorder label, an asword label, and a split label; and generating, via a text-to-speech computer system and an output device, audible speech from the application tokens in the text corpus, wherein the generating of the audible speech from the application tokens in the text corpus uses the text-to-speech pronunciation guideline.

2. The method of claim 1, further comprising:

comparing the application tokens to a language-independent pattern list that comprises number patterns, to yield a token comparison.

3. The method of claim 2, wherein the generating of the audible speech from the application tokens in the text corpus uses the token comparison.

4. The method of claim 1, wherein the text-to-speech pronunciation guideline further comprises at least one of: a spell label, an expand label, and a digits label.

5. The method of claim 1, wherein the audible speech is further generated for a given application token based on one of: N tokens to a left context and N tokens to a right context of the given application token.

6. The method of claim 1, wherein the generating of the audible speech further comprises generating the text-to-speech pronunciation guideline for at least one of the application tokens.

7. The method of claim 1, wherein the generating of the audible speech further comprises instructing a text-to-speech module how to pronounce at least one of the application tokens based on the text-to-speech pronunciation guideline.

8. The method of claim 1, wherein the text corpus is Unicode encoded.

9. The method of claim 1, further comprising normalizing the text corpus prior to the generating of the audible speech, wherein the normalizing comprises:

classifying the application tokens into classes; and modifying the text corpus using class-determined actions corresponding to the classes.

10. The method of claim 1, wherein the text-to-speech pronunciation guideline further comprises at least one selected from a group of: a cardinal label, a none label, and a foreign label.

11. The method of claim 1, wherein at least a part of the text-to-speech pronunciation guideline is language-independent.

12. A system comprising:

a processor configured to perform text-to-speech generation; and a computer-readable storage medium having instructions stored which, when executed by the processor, cause the processor to perform operations, the operations comprising:

receiving a text corpus;

tokenizing, via a tokenization module, the text corpus into application tokens, each application token of the application tokens comprising one of: a sequence of letters, a sequence of digits, and a punctuation, wherein the tokenization module is trained on training data generated by a feature extraction module that extracts morphological and lexical text features from a training data token and from an n-left token associated with the training data token or an n-right token associated with the training data token, wherein the tokenizing further comprises: for the each application token of the application tokens, assigning a label to the each application token based on a pronunciation of the sequence of letters, the sequence of digits, or the punctuation corresponding to the each application token, wherein the text-to-speech pronunciation guideline is identified based on the label, and wherein there are multiple candidate pronunciations for the sequence of letters, the sequence of digits, or the punctuation, and the pronunciation is selected from among the multiple candidate pronunciations based on a context of the each application token;

identifying a text-to-speech pronunciation guideline associated with each application token in the application tokens, wherein the text-to-speech pronunciation guideline comprises at least one of: a reorder label, an asword label, and a split label; and generating audible speech from the application tokens in the text corpus, wherein the generating of the audible speech from the application tokens in the text corpus uses the text-to-speech pronunciation guideline.

13. The system of claim 12, wherein the computer-readable storage medium stores additional instructions which, when executed by the processor, cause the processor to perform operations further comprising:

comparing the application tokens to a language-independent pattern list that comprises number patterns, to yield a token comparison.

14. The system of claim 13, wherein the generating of the audible speech from the application tokens in the text corpus uses the token comparison.

15. The system of claim 12, wherein the text-to-speech pronunciation guideline further comprises at least one of: a spell label, an expand label, and a digits label.

16. The system of claim 12, wherein the audible speech is further generated for a given application token based on one of: N tokens to a left context and N tokens to a right context of the given application token.

17. The system of claim 12, wherein the generating of the audible speech further comprises generating the text-to-speech pronunciation guideline for at least one of the application tokens.

18. The system of claim 12, wherein the generating of the audible speech further comprises instructing a text-to-speech module how to pronounce at least one of the application tokens based on the text-to-speech pronunciation guideline.

* * * * *